US005944566A

United States Patent [19]

Gossmann

[11] Patent Number: 5,944,566

[45] Date of Patent: Aug. 31, 1999

[54] TERMINAL FOR CONNECTING AN ELECTRICAL CONDUCTOR TO A BUS BAR

[75] Inventor: Christian Gossmann, Habsheim, France

[73] Assignee: Woertz AG, Muttenz, Switzerland

[21] Appl. No.: 08/942,621

[22] Filed: Oct. 2, 1997

[30] Foreign Application Priority Data

Oct. 2, 1996 [SE] Sweden ..... 2397/96

[51] Int. Cl.[6] ..... H01R 11/03

[52] U.S. Cl. ..... 439/792; 439/817

[58] Field of Search ..... 439/100, 728, 439/792, 811, 812, 813, 814, 815, 817

[56] References Cited

U.S. PATENT DOCUMENTS

| | | | |
|---|---|---|---|
| 2,157,846 | 5/1939 | Berndt | 439/792 |
| 4,072,393 | 2/1978 | McDermott et al. | 439/811 |
| 5,632,633 | 5/1997 | Roosdorp et al. | 439/100 |

*Primary Examiner*—Neil Abrams
*Assistant Examiner*—Javaid Nasri
*Attorney, Agent, or Firm*—Watson Cole Grindle Watson, P.L.L.C.

[57] ABSTRACT

The terminal (1) with stirrup-shaped base member (4) and spring-loaded pressure plate (6) retained to slide between the stirrup lateral sides (4',4") includes a respective recess (10,11) on each of the lateral sides that enables the terminal (1) to be set onto the bar (3) from the side over the conductor (2).

7 Claims, 2 Drawing Sheets

TERMINAL FOR CONNECTING AN ELECTRICAL CONDUCTOR TO A BUS BAR

BACKGROUND OF THE INVENTION

The invention relates to a terminal for pressing an electrical conductor against a bus bar or the like which has a stirrup-shaped base member provided for setting on the bar by means of retaining feet and a pressure plate provided on a guide bolt retained to slide in the stirrup yoke between the stirrup lateral sides, which pressure plate is pressed toward the lateral side ends by means of a compression spring.

The known terminals of this type used as shield terminals for grounding the shielding of shielded cables are disadvantageous in that they can often only be placed on a bar by using great force and with relatively great awkwardness.

The object of this invention is to provide a simply configured terminal, which in addition to its actual purpose, i.e., pressing a conductor onto a bus bar, is also especially easy for an operator to place on the bar.

SUMMARY OF THE INVENTION

This object was amazingly easy to accomplish by using a terminal wherein the lateral sides of the stirrup each provide a recess open to one side edge on the same side, each recess being restricted on a lower end by part of the lateral side forming a retaining arm with an upwardly-extending claw, such that the terminal can be set under the elastic yield of the pressure plate on the bus bar from the side by means of a conductor to be pressed on the bus bar.

The invention will be better understood by reference to the attached drawings taken in conjunction with the following discussion.

DETAILED DESCRIPTION OF THE PREFERRED EMBODIMENT

Figure 1:
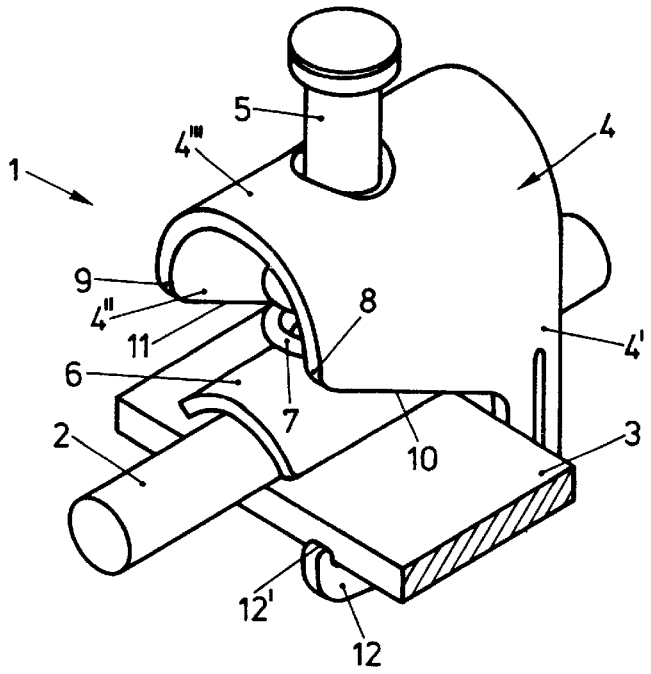
FIG. 1 is a perspective view of a terminal according to a preferred embodiment of the invention.
Figure 2:
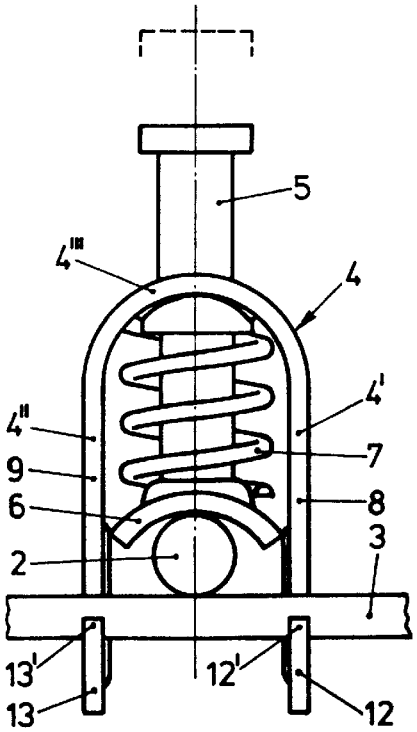
FIG. 2 is a front elevational view of the terminal according to FIG. 1.
Figure 3:
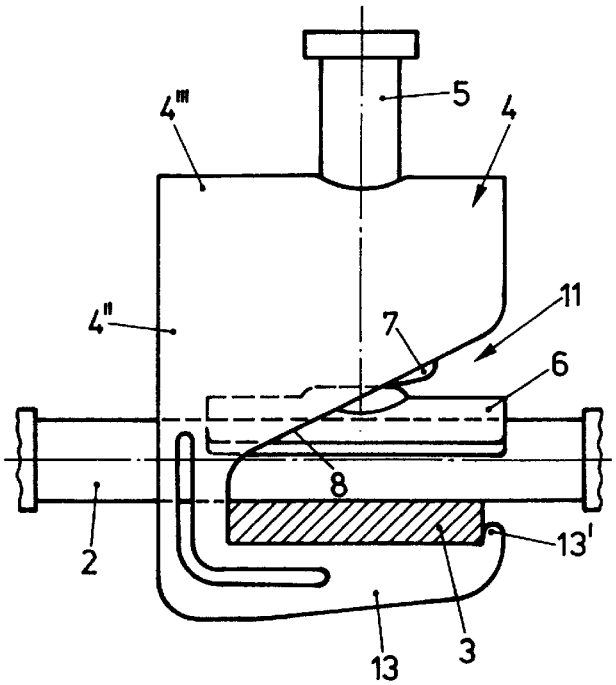
FIG. 3 is a side elevational view of the terminal according to FIG. 1.
Figure 4:
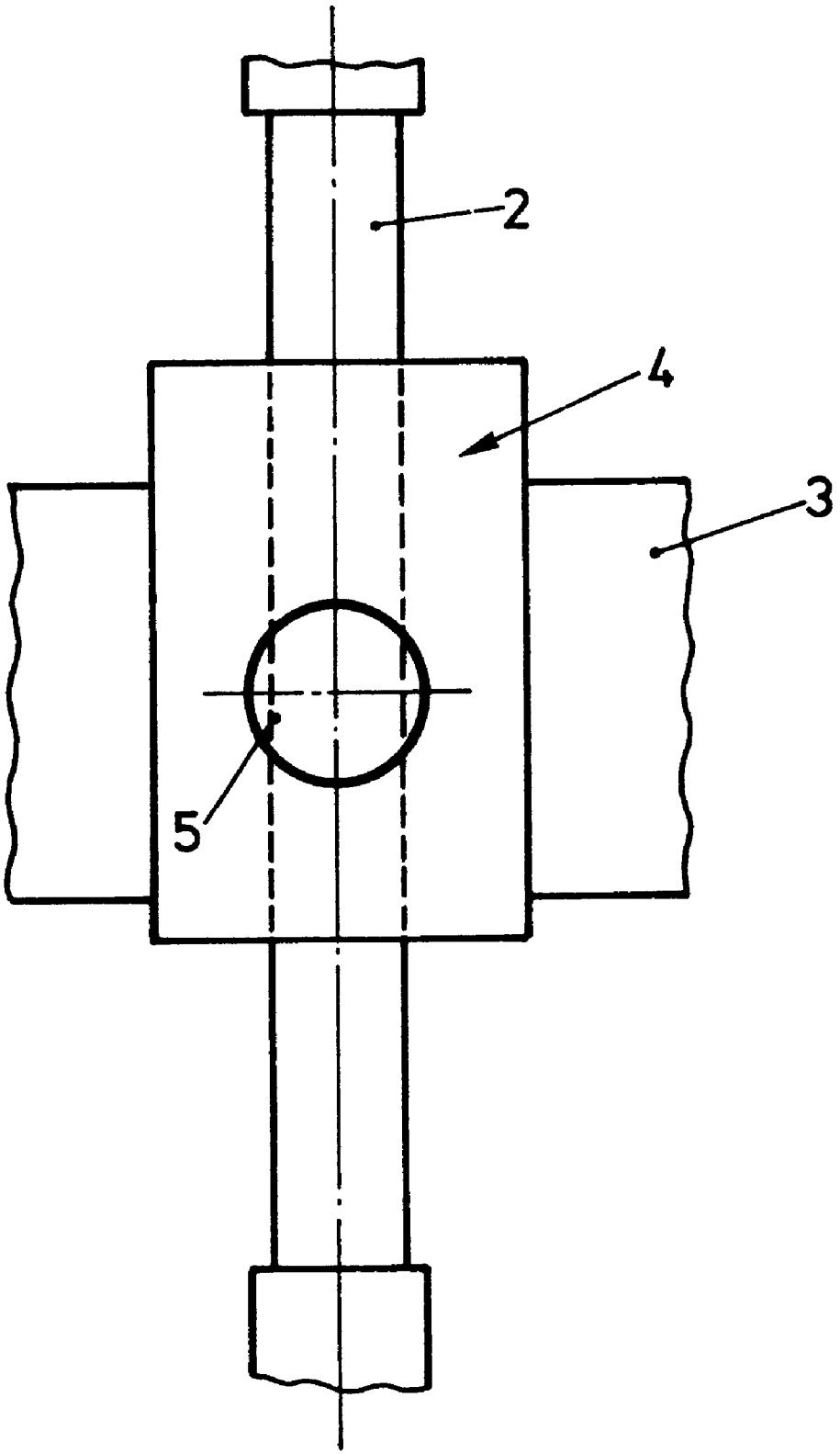
FIG. 4 is a top plan view of the terminal according to FIG. 1.

FIGS. 1–4 show a shield terminal 1 made of an electrically-conducting metal such as aluminum that serves to press an electrical conductor 2 on a bus bar 3. The latter is possibly connected with a grounding system.

Terminal 1 includes a stirrup-shaped base member 4, the lateral sides 4',4" of which form retaining feet for placing terminal 1 on bus bar 3. A guide bolt 5, which is movable between stirrup sides 4',4", is held in the stirrup yoke 4'". A pressure plate 6 is disposed on the lower end of guide bolt 5. A compression spring 7 is disposed between pressure plate 6 and stirrup yoke 4'", which compression spring presses pressure plate 6 guided on bolt 5 downward, thereby pressing conductor 2 against bar 3 when terminal 1 is set on rail 3. The pressure plate 6 defines a groove on its underside to hold conductor 2 against the bus bar 3, and in fact it can be in the form of a segment of a hollow cylinder.

Both stirrup lateral sides 4',4" each include a corresponding respective recess 10 and 11, extending inwardly from respective side edges 8 and 9, thereof, which recesses are configured at the lower end of the respective lateral sides to provide respective retaining arms 12 and 13, having upward-projecting end claws 12' and 13'. The recesses taper inwardly from side edges 8,9 to form wedges.

As a result of this design, terminal 1 can be set on bus bar 3 from the side, wherein pressure plate 6 can yield upwardly against the force of pressure spring 7, resulting in conductor 2 pressing against bus bar 3.

Modifications in the invention can be made and still fall within the scope of the appended claims.

I claim:

1. A terminal for pressing an electrical conductor against a bus bar, comprising a stirrup-shaped base member including lateral sides connected by an upper yoke, said lateral sides including support surfaces for placement on said bus bar; a clamping means connected to said base member, said clamping means comprising a guide bolt which slidingly extends downwardly through an opening in said yoke, a pressure plate mounted on a lower portion of said guide bolt for contacting the electrical conductor to be positioned between said lateral sides of said base member, and a spring means located between said pressure plate and said yoke, said spring means biasing in a self acting manner said pressure plate downwardly; said two lateral sides of the base member including corresponding recesses that extend inwardly from corresponding side edges of said lateral sides to provide said lateral sides with corresponding support arms forming said support surfaces and having upwardly extending claws, said recesses enabling the terminal with said electrical conductor placed against said pressure plate to be snapped from the side onto the bus bar, whereby said electrical conductor extending through said base member is biased against the bus bar positioned on said support arms.

2. The terminal according to claim 1, wherein each said recess tapers inwardly to form a wedge from the side edge of the lateral side.

3. The terminal according to claim 1, wherein the pressure plate comprises at least one groove on an underside thereof into which the conductor extends for holding the conductor against said bus bar.

4. The terminal according to claim 1, wherein the pressure plate is in the form of a hollow cylinder segment.

5. The terminal according to claim 1, wherein it consists of an electrically-conducting material.

6. The terminal according to claim 5, wherein said electrically-conducting material is metal.

7. The terminal according to claim 6, wherein said metal is aluminum.

* * * * *

UNITED STATES PATENT AND TRADEMARK OFFICE

CERTIFICATE OF CORRECTION

PATENT NO. : 5,944,566

DATED : August 31, 1999

INVENTOR(S) : Christian GOSSMANN

It is certified that error appears in the above-identified patent and that said Letters Patent is hereby corrected as shown below:

On the title page item,

[30] Foreign Application Priority Data
Oct. 2, 1996 [CH] Switzerland .....2397/96

Signed and Sealed this
Fourth Day of January, 2000

*Attest:*

*Attesting Officer*

*Acting Commissioner of Patents and Trademarks*